United States Patent [19]

Thompson

[11] Patent Number: 4,465,620

[45] Date of Patent: Aug. 14, 1984

[54] PREVENTION OF COPPER PLATING DURING CHEMICAL CLEANING OPERATIONS

[75] Inventor: Neil E. S. Thompson, St. Louis, Mo.

[73] Assignee: Petrolite Corporation, St. Louis, Mo.

[21] Appl. No.: 519,153

[22] Filed: Aug. 1, 1983

[51] Int. Cl.[3] ..... C11D 1/70; C23F 11/14; C23F 11/16; C23G 1/02

[52] U.S. Cl. ..... 252/545; 134/3; 422/11; 422/12; 422/16; 252/180

[58] Field of Search ..... 134/3; 422/11, 12, 16; 252/180, 545

[56] References Cited

U.S. PATENT DOCUMENTS 2,889,276 6/1959 Barrett et al. ..... 422/12
3,506,576 4/1970 Teumac ..... 134/3
3,853,618 12/1974 Smith ..... 134/3
4,281,118 7/1981 Dunbar et al. ..... 424/248.52

FOREIGN PATENT DOCUMENTS 2010024 2/1970 France ..... 564/291

OTHER PUBLICATIONS

Chemical Abst., vol. 92, No. 170103c (1980).

*Primary Examiner*—John E. Kittle
*Assistant Examiner*—Mukund J. Shah
*Attorney, Agent, or Firm*—Robert E. Wexler

[57] ABSTRACT

There is provided a composition which inhibits corrosion and copper plate-out during chemical cleaning of a steam or water carrying system. The composition comprises an α-aminoalkylsulfide and a surface active agent.

22 Claims, No Drawings

PREVENTION OF COPPER PLATING DURING CHEMICAL CLEANING OPERATIONS

BACKGROUND OF THE INVENTION

Field of the Invention

This invention relates to chemical cleaning systems. More particularly, the invention relates to novel corrosion and copper plating inhibiting compositions which are useful in chemical cleaning systems and the method of use thereof in such systems.

Steam generation plants, and the various subsystems therein, such as condensers, heat exchangers, boilers and the like, are normally cleaned using chemical cleaning compositions comprising strong acid solutions, such as aqueous hydrochloric acid, chelants, sulfuric acid, hydroxyacetic-formic acid and the like.

COPPER PLATE-OUT

Copper and copper alloys are often utilized in steam generation plants as tubing metals in condensors and heat exchangers, as well as in other equipment which comes in contact with steam and condensate. When condensate is returned to the boiler feed water system, as is typical in many utility and industrial plants, it contains trace amounts of copper. Although the copper may be present at very low concentrations (10 ppb or less), it can eventually constitute a significant part of the overall boiler deposit inventory. Thus, in a boiler feed water system carrying an average of 10 ppb concentration of copper into a boiler evaporating 1 million pounds of steam per hour for 1 year, the system could accumulate between 210 and 260 pounds of copper during that period, assuming that none of the copper is removed in the boiler blow down and that the boiler is cleaned every 3 years. The boiler might also contain 2,000 to 2,500 pounds of iron oxide ($Fe_3O_4$). Thus, copper may constitute 10 to 15% by weight of the total boiler deposit material.

When such a boiler is acid-cleaned, a number of reactions take place. All of these reactions lead to the redeposition of metallic copper on the boiler metal surfaces, thus:

(1) Any copper oxide present will dissolve and be reduced at the expense of steel;

$$Cu_2O+2HCl \rightarrow Cu_2Cl_2+H_2O$$

$$Cu_2Cl_2+Fe^{\circ} \rightarrow 2Cu^{\circ}+FeCl_2$$

For each pound of copper oxide present, about 0.2516 pounds of steel will be dissolved.

(2) If the copper in the deposit is present as metallic copper, it may remain in the metallic state or be dissolved by oxidation reaction with ferric ions, only to redeposit again as metallic copper;

$$Fe_3O_4+8\ HCl \rightarrow 2FeCl_3+FeCl_2+4H_2O$$

$$2FeCl_3+2Cu^{\circ} \rightarrow 2FeCl_2+CuCl_2$$

$$Cu_2Cl_2+Fe^{\circ} \rightarrow 2Cu^{\circ}+FeCl_2$$

For each pound of metallic copper which is oxidized by ferric ions, about 0.225 pounds of steel will be dissolved. Depending on its form and location in the deposit, not all of the metallic copper originally present in the deposit may dissolve. However, copper which enters solution will redeposit on steel surfaces.

This plating-out of copper interferes with boiler and steam flow in the system and leads to overheating. Further, the fact that copper remains in the system after acid-cleaning makes the next chemical cleaning operation more difficult.

In order to overcome the complicated and potentially dangerous copper-plating problem, it has been necessary, in the past, to employ a 2-stage cleaning operation. The cleaning starts with a copper removal stage using 10% ammonia solution at 25° C., with air sparging to provide oxidizing conditions and assist solvent circulation. Depending on the amount of copper present, several copper removal stages are usually required. Following the copper removal stages, iron removal stages are repeated until the magnetite is removed. Because of the concern of copper plate-out leading to enhanced corrosion of carbon steel, the final cleaning stage is a copper removal stage.

CORROSION INHIBITION

To minimize attack on metals during chemical cleaning with acid solutions containing dissolved iron in the ferric state, both hydrogen evolution corrosion and ferric ion corrosion must be effectively inhibited.

The three principal chemical reactions describing metal loss during chemical cleaning are summarized as follows:

(1) reaction of acids with base metal:

$$2H^{+}+Fe^{\circ} \rightarrow FE^{++}+H_2\uparrow$$

Two equivalents of acid consume one equivalent of steel.

(2) Reaction of soluble ferric ions with steel:

$$2Fe^{+++}+Fe^{\circ} \rightarrow 3Fe^{++}$$

Two equivalents of ferric ion consume one equivalent of steel.

(3) Reaction of soluble copper with steel:

$$2Cu^{+}+Fe^{\circ} \rightarrow Fe^{++}+2Cu^{\circ}$$

Two equivalents of soluble copper consume one equivalent of steel.

Prior Art

There are many inhibitors which effectively reduce hydrogen evolution corrosion (Reaction 1), but such inhibitors have little or no effect on ferric ion or cuprous ion corrosion (Reactions 2 and 3). It is commonly known that the enhanced corrosion rate due to the presence of ferric ions in solution cannot be efficiently inhibited by the organic or inorganic inhibitors currently employed. Accordingly, corrosion which is caused by ferric ions has been either ignored or accepted as a necessary side effect of the removal of deposits by chemical treatment.

Accordingly, it is evident that corrosion and the plating-out of copper during chemical cleaning of systems containing copper is a problem which has yet to be overcome. It would obviously be advantageous if there were a composition which would prevent the plate-out of copper during the chemical cleaning of systems containing same and, at the same time, reduce hydrogen evolution and ferric ion or cuprous ion corrosion.

In view of the above, it is an object of the present invention to provide novel compositions of matter containing the novel blend of the invention.

Another object of the invention is to provide a method of inhibiting corrosion during chemical cleaning of metals.

Another object of the invention is to provide a novel method of inhibiting copper plate-out during chemical cleaning of metals.

Another object is to provide a novel method of cleaning steam generating systems.

Another object is to provide a novel single fill cleaning method for cleaning water-carrying systems.

These and other objects are accomplished using the novel compositions of the invention.

SUMMARY OF THE INVENTION

In accordance with the present invention, there has now been discovered a novel composition which effectively inhibits corrosion and the plate-out of copper during chemical cleaning and the use of which provides the basis for a single-fill cleaning process capable of dissolving iron oxides, copper and copper oxides, leaving passive, cleaned metal surfaces. The novel inhibitor composition is particularly effective when aqueous hydrochloric acid is used as the cleaning solvent. The inhibitor composition comprises a blend of certain alpha-aminoalkylsulfides and certain surface active agents.

Prior Art

French Pat. No. 2,010,024, 1970, discloses the reaction of dimethylamine and N-dodecylmercaptan and the reaction of N-benzylmethylamine with dimethylamine and N-dodecylmercaptan. The compounds are disclosed to have utility as intermediates in making quaternary compounds.

A paper by Egutkin, summarized in *Chemical Abstracts,* Volume 92, page 412, 170103C (1980) discloses compounds such as $C_8H_{17}(SCH_2NEt_2$ and $C_8H_{17}SCH_2NR_2$ wherein $NR_2$ represents piperidinyl. The reason for the open parentheses in the first compound is not known. The compounds are disclosed as being useful in the extraction of nonferrous metals.

DETAILED DESCRIPTION OF THE INVENTION

Alpha-aminoalkylsulfides which are useful in the present invention are described in U.S. Ser. No. 301,620, filed Sept. 14, 1981 and assigned to the present assignee. The alpha-aminoalkylsulfides are represented by the following general formula:

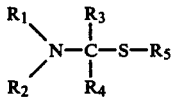

wherein $R_1$, $R_2$, $R_3$, $R_4$ and $R_5$ are the same or different and independently represent hydrogen, or an aliphatic or aromatic hydrocarbon group such as alkyl, for example methyl, ethyl, propyl, octyl, dodecyl, cycloalkyl, e.g., cyclobutyl, cyclohexyl, aryl, e.g., phenyl and the like and which groups may contain substituent groups such as halo, e.g., chloro or bromo, and/or hydroxyl and/or nitro groups. The R groups may also be joined to form rings, for example, $R_1$ and $R_2$, $R_1$ and $R_3$, $R_1$ and $R_5$ and the like which may be composed of hydrocarbon and/or substituted hydrocarbon groups and may contain hetero atoms such as oxygen and/or nitrogen and/or sulfur, e.g.,

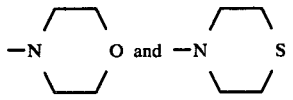

The alpha-aminoalkylsulfides may be prepared by a wide variety of methods known in the art.

A particularly effective method of preparation of such compounds involves the interaction of an amine, an aldehyde or ketone and a thiol as depicted in Equation 1.

Equation 1

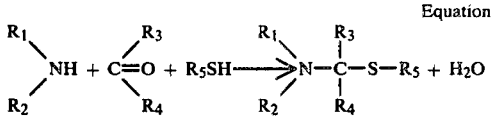

The reaction can be carried out with or without solvents such as alcohols and hydrocarbons at temperatures of from about 0° to about 200° C. Preferred temperatures are in the range of about 20° to about 80° C. The amine component is primary or secondary, i.e., $R_1$ is alkyl or aryl and $R_2$ is H, or both $R_1$ and $R_2$ can be heterocyclic, such as pyrrolidine, morpholine, piperidine and the like; $R_1$ can be methyl, ethyl, propyl, butyl, hexyl, octyl, decyl, dodecyl, tetradecyl, hexadecyl, octadecyl, phenyl and the like; $R_2$ can have the same or similar structures as $R_1$, including H.

The carbonyl component is an aldehyde or ketone and $R_3$ and $R_4$ are the same or different, including H, alkyl such as methyl, ethyl, propyl, isopropyl, butyl, alicyclic, e.g., cyclobutyl, cyclohexyl, aryl, e.g., phenyl and the like.

In the thiol component, $R_5$ can vary widely, including alkyl groups such as methyl, ethyl, propyl, butyl, pentyl, hexyl, heptyl, octyl, nonyl, decyl, undecyl, dodecyl, tetradecyl, hexadecyl, octadecyl and aryl, such as phenyl, and the like. Branched alkyl groups can also be present.

An alternative procedure is depicted in Equation 2 in which a thiol is added to a Schiff Base or imine.

Equation 2

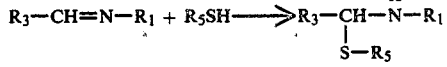

The possible variations in the R groups are as set forth in Equation 1.

A further method which yields cyclic products is shown in Equation 3 wherein the amine and thiol functions are contained in the same molecule.

Equation 3

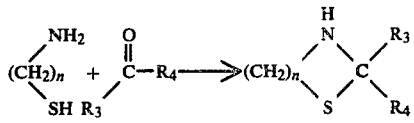

n = 2,3

An additional preparative method which also yields cyclic products is described in Equation 4. In this procedure sulfur interacts with the carbonyl compound to generate the C—S—H group. Several examples of this method have been described in the literature, e.g., F. Asinger and M. Thiele, Agnew. Chem., 70, 667(1958), F. Asinger et. al., Annalen, 615, 84(1958) and references cited therein, F. Asinger and W. Leuchtenberger, Annalen, 1183 (1974).

Equation 4

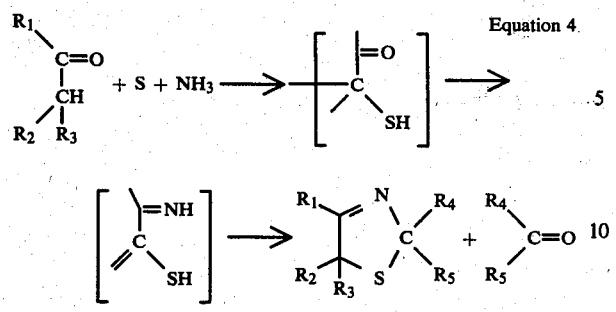

In the simplest examples,

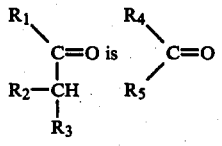

For example in the specific case of cyclohexanone, the reaction is as follows:

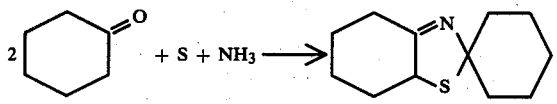

A useful extension of this process is to use a substoichiometric amount of sulfur which leads to a mixture of products which can be particularly advantageous. If, for example, cyclohexanone, ammonia and less than an equivalent of sulfur are reacted, a mixture shown in Equation 5 is obtained. Further heating can lead to partial deammoniation as shown in Equation 6. The procedures involving carbonyl compounds and ammonia (without sulfur) are disclosed in U.S. Pat. Nos. 3,931,191, 3,904,625 and 4,113,730.

Equation 5

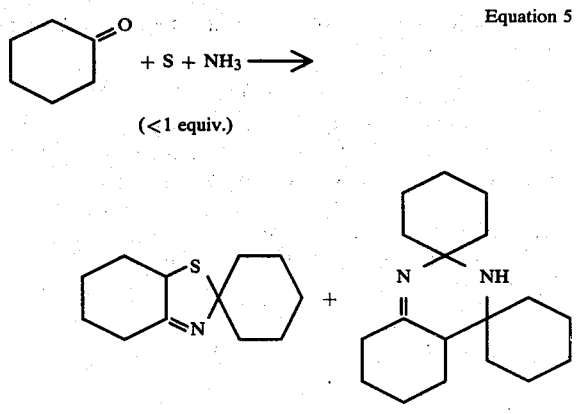

Equation 6

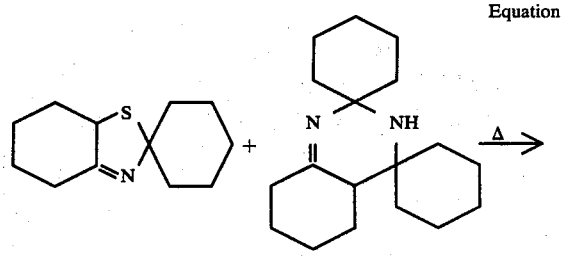

-continued

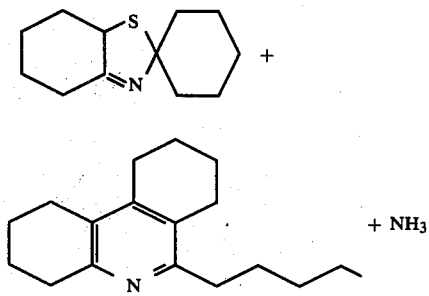

A general reference to the preparation of the structures described herein can be found in H. Hellmann and G. Opitz, α-Aminoalkylierung, Verlag-Chemie GMBH, Weinheim/Bergstr. 1960.

The following examples illustrate specific embodiments of the invention, but are intended as illustrative and are not included by way of limitation.

PREPARATION OF α-AMINOALKYLSULFIDES

Example 1—Reaction product of a secondary amine

To a 40% aqueous solution of dimethylamine (12 ml; 0.1 mole), cooled in an ice bath, was added aqueous 37% formaldehyde (10 ml; 0.13 mole) dropwise during 30 minutes. To this mixture was added dodecylthiol (20 g; 0.1 mole) in one portion and stirring was continued for one hour. After saturation with potassium carbonate, the organic phase was separated. The product was identified as shown in the formula below:

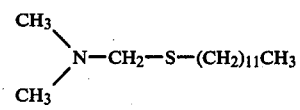

Example 2—Reaction product of a secondary amine

Diethylamine (7.3 g; 0.1 mole) was dissolved in isopropanol (20 g), cooled in an ice bath and stirred during the addition of 37% formaldehyde (10 ml; 0.13 mole). To this solution was added octylthiol (14.6 g; 0.1 mole) in one portion and the mixture was stirred to give a homogeneous solution of the desired aminomethylated thiol of the formula:

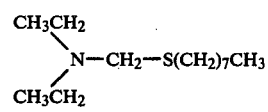

Example 3—Reaction product of a primary amine

To a solution of octylamine (13 g; 0.1 mole) in isopropanol (68 g), cooled in an ice bath, was added aqueous formaldehyde (10 ml; 0.13 mole) during 20 mins with efficient stirring. Dodecylthiol (20 g; 0.1 mole) was added and the reaction completed by stirring at ambient temperature for 1 hour. The product is represented by the formula:

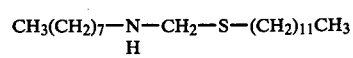

To avoid unnecessary repetition, Table 1 summarizes additional compounds prepared by the method of Examples 2 and 3.

TABLE 1

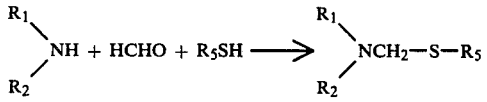

| EXAMPLE | $R_1$ | $R_2$ | $R_5$ |
|---|---|---|---|
| 4 | $CH_3CH_2$— | $CH_3CH_2$— | $CH_3(CH_2)_{11}$— |
| 5 | $HOCH_2CH_2$— | $HOCH_2CH_2$— | $CH_3(CH_2)_7$— |
| 6 | $CH_3CH_2CH_2$ | $CH_3CH_2CH_2$— | $CH_3(CH_2)_7$— |
| 7 | $CH_3CH_2CH_2$— | $CH_3CH_2CH_2$— | $CH_3(CH_2)_{11}$— |
| 8 | $HOCH_2CH_2$— | $HOCH_2CH_2$— | $CH_3(CH_2)_{11}$— |
| 9 | $CH_3(CH_2)_3$— | $CH_3(CH_2)_3$— | $CH_3(CH_2)_{11}$— |
| 10 | —$CH_2CH_2$—O—$CH_2CH_2$— | $R_1$ & $R_2$ | $CH_3(CH_2)_{11}$— |
| 11 | —$(CH_2)_5$— | joined to | $CH_3(CH_2)_{11}$— |
| 12 | —$(CH_2)_5$— | form ring | $CH_3(CH_2)_7$— |
| 13 | $cC_6H_{11}$— | $cC_6H_{11}$— | $CH_3(CH_2)_{11}$— |
| 14 | $cC_6H_{11}$— | $cC_6H_{11}$— | $CH_3(CH_2)_7$— |
| 15 | $CH_3(CH_2)_3$— | H | $CH_3(CH_2)_{11}$— |
| 16 | $CH_3(CH_2)_3$— | H | $CH_3(CH_2)_{11}$— |
| 17 | Cocoalkyl— | Cocoalkyl— | $CH_3(CH_2)_{11}$— |

c means cyclic

The following examples illustrate the preparation of α-aminoalkylsulfides using polyamines and hydroxyalkyl polyamines.

Example 18

Diethylene triamine (10.3 g; 0.1 mole) was dissolved in isopropanol (60 g) and, after cooling to 5°-10° C., the solution was stirred during the addition of 37% aqueous formaldehyde (10 ml; 0.13 mole). To this solution was added dodecylthiol (20.2 g; 0.1 mole) and the reaction completed by stirring one hour at 30° C. The product is an aminomethylated thiol represented by the formula:

$C_{12}H_{25}S—CH_2—(C_4H_{12}N_3)$

Example 19

Hydroxyethyl ethylenediamine (10.4; 0.1 mole) was dissolved in isopropanol (60 g) and cooled to 5° C. before the dropwise addition of 37% aqueous formaldehyde (10 ml; 0.13 mole) during 20 mins. While stirring was continued, dodecylthiol (20.2 g; 0.1 mole) was added and the reaction completed in 1 hour at ambient temperature.

The product is represented by the following formula:

$C_{12}H_{25}SCH_2—C_4H_{11}N_2O)$

The following examples illustrate the preparation of alkoxylated α-aminoalkylsulfides.

Example 20

Triethylenetetramine ethoxylated with 2 moles of ethylene oxide (23.4 g; 0.1 mole) was dissolved in isopropanol (39 g), cooled to 5°-10° C. and treated, dropwise, with 37% aqueous formaldehyde (10 ml; 0.13 mole). While continuing to stir dodecylthiol (20.2 g; 0.1 mole) was added and the reaction completed at ambient temperature in one hour. The product is represented by the formula:

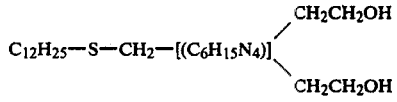

Example 21

In a manner similar to that of Example 20 triethylenetetramine, propoxylated with two moles of propylene oxide, was reacted in sequence with formaldehyde and dodecylthiol. The product is represented by the formula:

$C_{12}H_{25}—S—CH_2—(C_6H_{15}N_4)(CH_2—CH(CH_3)OH)_2$

The following examples illustrate the use of higher aldehydes.

Example 22

To a solution of n-butylamine (8 g; 0.11 mole) in isopropanol (66 g) at 5°-10° C. was added butyraldehyde (8 g; 0.11 mole) with stirring. After 30 mins. dodecylthiol (20 g; 0.1 mole) was added and the mixture stirred at ambient temperature for one hour.

The product is represented by a mixture of compounds having the formulas:

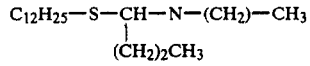

and

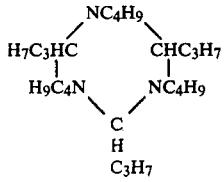

-continued

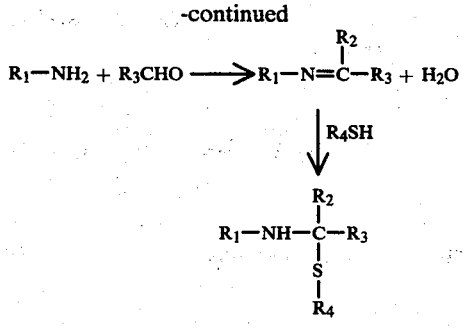

TABLE 2

| EXAMPLE | $R_1$ | $R_2$ | $R_3$ | $R_4$ |
|---|---|---|---|---|
| 23 | $CH_3(CH_3)_3$— | H | $CH_3(CH_2)_2$— | $CH_3(CH_2)_7$— |
| 24 | $CH_3(CH_2)_5$— | H | $CH_3(CH_2)_2$— | $CH_3(CH_2)_7$— |
| 25 | $CH_3(CH_2)_6$— | H | $CH_3(CH_2)_2$— | $CH_3(CH_2)_{11}$— |
| 26 | HO $CH_2CH_2$— | H | $CH_3(CH_2)_2$— | $CH_3(CH_2)_{11}$— |
| 27 | $cC_6H_{11}$— | H | $CH_3(CH_2)_2$— | $CH_3(CH_2)_{11}$— |
| 28 | $CH_3(CH_2)_7$— | H | $CH_3(CH_2)_2$— | $CH_3(CH_2)_{11}$— |
| 29 | $CH_3(CH_2)_{11}$— | H | $CH_3(CH_2)_2$— | $CH_3(CH_2)_{11}$— |
| 30 | $tC_4H_9$— | H | $(CH_3)_2CH$— | $tC_{12}H_{25}$— |
| 31 | $NH_2CH_2CH_2$— | H | $CH_3(CH_2)_2$— | $CH_3(CH_2)_7$— |
| 32 | $HO(CH_2)_2NH(CH_2)_2$— | H | $CH_3(CH_2)_2$— | $CH_3(CH_2)_7$— |

The following examples illustrate sulfides containing the N—C—S grouping in a ring Example 33—2,2-Pentamethylene-4,5-tetramethylene-$\Delta^3$-thiazoline Sulfur (32 g; 1 mole) was suspended in cyclohexanone (196 g; 2 mole) by vigorous stirring in a sealed reactor while gaseous ammonia was introduced. Cooling was applied as necessary to keep the temperature between 40°-50° C. Ammonia was added at a rate such that a pressure of 25-30 psi was maintained. The uptake of ammonia ceased after 2-3 hours. Stirring was discontinued and aqueous phase separated and discarded. Distillation of the organic phase yielded 2,2-pentamethylene-4,5-tetramethylene-$\Delta^3$-thiazoline having the formula:

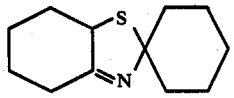

The product was characterized by infrared and nuclear magnetic resonance spectra.

Example 34

(a) The reaction between cyclohexanone/ammonia and less than 1 equivalent of sulfur Cyclohexanone (200 g; 2.04 mole), sulfur (10 g; 0.31 mole) and ammonium nitrate (10 g; 0.13 mole) were placed in a pressure reactor and, while stirring, ammonia gas was added. A pressure of 30-40 psi was maintained with the reaction temperature between 50°-60° C. Ammonia uptake ceased at approximately 16 hours. Stirring was stopped and the upper aqueous phase which separated discarded. The infrared spectrum shows a strong C=N peak at 6.05μ from the tetrahydropyrimidine and thiazoline.

(b) Conversion of the tetrahydropyrimidine component to pyridine

The organic phase of 34(a) was charged to a 500 ml reactor equipped with stirrer, thermometer and reflux condenser attached to a Dean Stark trap. Nitric acid (4 g) was carefully added and the mixture gradually heated to 190°-200° C. for 5-6 hours, while removing any water or low boiling by products. The progress of the reaction was followed by a decrease in the off gas evolution and by a change in infrared spectral characteristics. The peak at 6.02μ, —C=N—, disappears and a strong peak at 6.40μ (pyridine) appears.

The product gave the following analysis; S, 5.2%, N, 5.15%. Gas chromatography showed the product contained the two compounds below as major components.

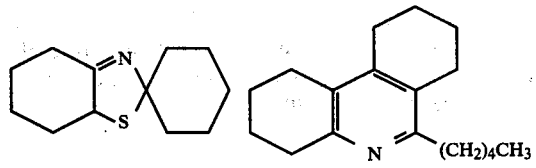

Example 35

A cyclohexanone/ammonia/sulfur reaction with less than 1 equivalent of sulfur

This example follows the procedure of example 34 using cyclohexanone (200 g; 2.04 mole), and sulfur (20 g; 0.625 mole). The product is similar to the previous example except that the ratio of thiazoline to phenanthridene is 13:7.

In summary, the invention relates to compositions containing α-aminoalkylsulfide compounds characterized by the formula:

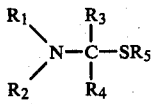

where the R groups are defined above.

In the preferred embodiments, $R_1$ and $R_5$ are alkyl or substituted alkyl, $R_2$ is alkyl or hydrogen; $R_3$ is hydrogen and $R_4$ is either hydrogen or alkyl. $R_1$ and $R_2$ may also be joined to form an amino-containing ring such as

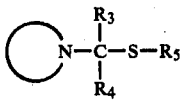

but preferably

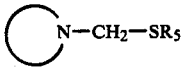

Where the compound is derived from a polyamine the composition may be represented by the formula

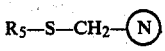

wherein (N) represents a polyamine moiety.

The compound may be part of a ring structure such as represented by the following thiazoline structure

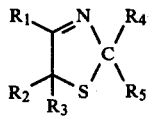

where $R_1$, $R_2$, $R_3$, $R_4$, $R_5$ are hydrocarbon groups such as alkyl, aryl, or hydrogen.

$R_1$ and $R_2$ and $R_4$ and $R_5$ may also be joined in a cyclic structure as represented below

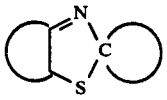

Where thiazolines are formed by reacting the carbonyl with ammonia and an equivalent of S, one obtains primarily the thiazoline, for example

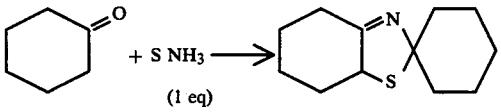

Where one reacts the carbonyl with less than an equivalent of S, one obtains a mixture of the thiazoline and the tetrahydropyrimidine, for example

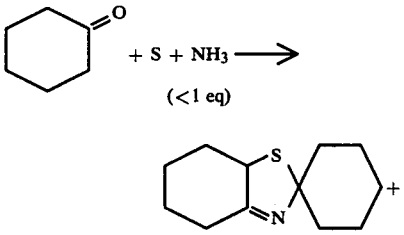

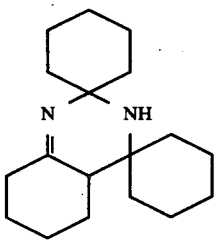

On further heating the tetrahydropyrimidine formed can be deammoniated to phenanthridene as illustrated by the following

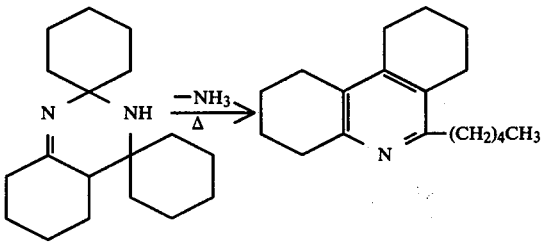

The above compounds are prepared according to the following reactions:

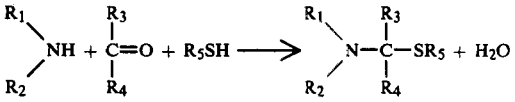

I

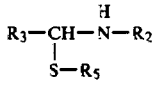

II

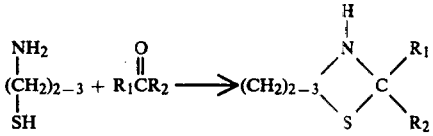

IV

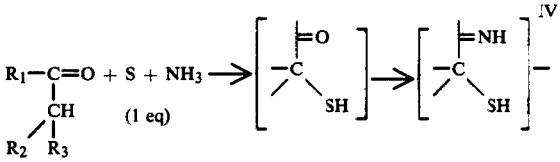

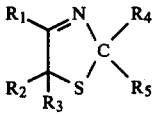

For example

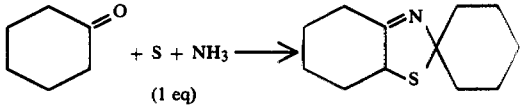

V

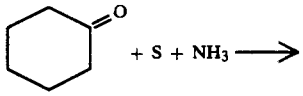

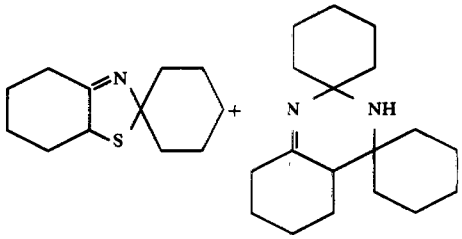

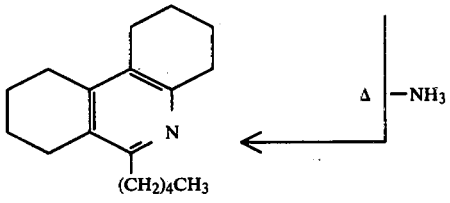

Nonionic surface active agents utilized in the present invention are represented by the formula:

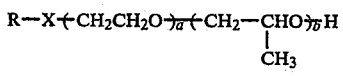

wherein R is a hydrocarbon or substituted hydrocarbon group such as alkyl, aryl and the like; X is oxygen, sulfur or nitrogen and a and b represent a number from 0 to about 30. These nonionic surface active agents are commonly made by oxyalkylating alcohols, thiols, amines and phenols with alkylene oxides, such as ethylene oxide, propylene oxide and the like.

It has been found that the alpha-aminoalkylsulfides and the non-ionic surface active agents effectively inhibit the plating-out of copper on ferrous surfaces during exposure thereof to chemical cleaning systems containing acids such as hydrochloric acid. Surface active agents other than the preferred species set forth above, may be used in the present invention but are less effective. Cationic and anionic surface active agents may be used but must be judiciously chosen since they are not as as effective and, in some cases, may increase the corrosion rate.

For optimum corrosion and copper plate-out inhibition, both the alpha-aminoalkylsulfides and the surface active agents must be of a specific structural configuration. For example, the nonionic surface active agents derived from dinonylphenol are the most effective in conjunction with inhibitors derived from alkyl thiols containing from about 8 to about 12 carbon atoms. Thus, the most preferred surface active agents are nonionic and may be represented by the following formula:

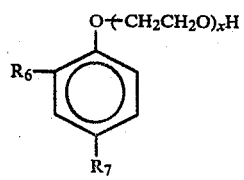

wherein $R_6$ and $R_7$ represent 4–10 carbon atom linear or branched-chain hydrocarbon radicals, e.g., t-butyl, amyl, hexyl, heptyl, octyl, nonyl, decyl, and x represents a number of from 2 to about 10.

Besides effectively inhibiting copper plate-out and both ferric ion and hydrogen evolution corrosion, the compositions of the invention also afford the following benefits:

1. The compositions are particularly effective in hydrochloric acid. Hydrochloric acid, a strong mineral acid, has been and continues to be widely applied as a chemical cleaning agent because of its rapid reactivity in dissolving most metallic corrosion product oxides and its ability to dissolve many water-formed deposits. Properly inhibited hydrochloric acid has been the principal chemical in the cleaning field and its relative low cost helps maintain its dominant position. The compositions enhance the effectiveness of hydrochloric acid.

2. The compositions prevent after-rusting following acid cleaning and retard subsequent rusting after drying.

3. The compositions do not retard the dissolution of metallic corrosion product oxides, such as magnetite.

4. The compositions do not form water insoluble oxides or scum.

The compositions of the invention comprises at least one of the α-aminoalkylsulfides and at least one of the surfactants described.

The following nonlimiting examples illustrate specific embodiments of the inhibitor composition of the invention and the best mode of practice thereof.

Example 36

Preparation of di(hydroxyethyl) aminomethyl octylsulfide, $C_8H_{17}SCH_2N—(CH_2CH_2OH)_2$ To diethanolamine (10.5 gm; 0.1 mole) was added aqueous formaldehyde (10 ml 37% solution; 0.13 mole) with cooling and stirring.

To the solution was added octylthiol (14.6 gm; 0.1 mole) in one portion and the mixture was stirred at room temperature for 1 hour. Di(hydroxyethyl) aminomethyl octylsulfide was obtained as a clear, homogeneous solution.

Example 37

Preparation of di(butyl) aminomethyl dodecylsulfide, $C_{12}H_{25}SCH_2N(C_4H_9)_2$ Dibutylamine (129 gms.; 0.1 mole) was dissolved in isopropanol (25 gms). The solution was cooled in an ice bath and stirred during addition of aqueous formaldehyde (9 ml of 37% solution; 0.11 mole). To the solution there was added dodecylthiol (20.2 gms; 0.1 mole) in one portion and the mixture was stirred for 1 hour at room temperature. Di(butyl) aminomethyl dodecylsulfide was obtained as a clear, homogeneous solution.

In like manner, there were prepared di(ethyl) aminomethyl octylsulfide, di(hydroxyethyl) aminomethyl dodecylsulfide and piperidino aminomethyl octylsulfide.

Other α-aminoalkylsulfides which may be prepared in like manner are:

di(propyl) aminomethyl nonylsulfide
di(amyl) aminomethyl decylsulfide
di(hexyl) aminomethyl phenylsulfide
di(heptyl) aminomethyl phenylsulfide
di(octyl) aminomethyl benzylsulfide
di(nonyl) aminomethyl chlorophenylsulfide
di(dodecyl) aminomethyl pentadecylsulfide
di(cyclobutyl) aminomethyl octadecylsulfide
di(allyl) aminomethyl octylsulfide
di(nonadecyl) aminomethyl cycloheptylsulfide
di(butyl) aminomethyl furanylsulfide
di(methyl) aminomethyl thiazolylsulfide
di(ethyl) aminomethyl pyridylsulfide
di(amyl) aminomethyl quinolinylsulfide
di(hydroxyethyl) aminomethyl thiophenylsulfide

Example 38

Preparation of surfactant

There was charged to a pressure reactor 25 gms of "ALFOL" 8–10 alcohol (linear alcohols, Conoco) and flaked potassium hydroxide (1 gram). The reaction mixture was heated to 125° C. and propylene oxide (25 grams) and ethylene oxide (50 grams) were added. The temperature was increased to 135° C. and held for 1 hour.

Example 39

Preparation of surfactant

There was charged to a pressure reactor dinonyl phenol (45 gms) and flaked potassium hydroxide (0.5 gms). The reaction mixture was heated to 125° C. and ethylene oxide (55 gms.) was added. Heating was continued at 125° C. for 1 hour.

In like manner, the following nonionic surfactants* were prepared (numerals preceeding the alkylene oxide indicate the weight ratio of alkylene oxide used in relation to the weight of phenol used):

"ALFOL" 810+1.00 EtO
"ALFOL" 810+2.00 EtO
"ALFOL" 810+2.00 EtO+1.0 Pro
"ALFOL" 1214+2.17 EtO
t-butylphenol+2.46 EtO
di-sec-butylphenol+2.75 EtO
di-sec-butylphenol+2.75 EtO+1.75 BuO
nonylphenol+1.00 EtO
nonylphenol+2.00 EtO
dinonylphenol+1.10 EtO
dinonylphenol+1.37 EtO
dinonylphenol+4.00 EtO
octylthiol+1.00 EtO
"ARMEEN" T+3.67 EtO

*"ALFOL" is a registered trademark of Conoco Chemical Co.
"ARMEEN" is a registered trademark of Armak Co.
"ALFOL" 810 is a mixture of primary, linear $C_8$–$C_{10}$ alcohols
"ALFOL" 1214 is a mixture of primary, linear $C_{12}$–$C_{14}$ alcohols
EtO=ethylene oxide
PrO=propylene oxide
BuO=butylene oxide The test conditions were as follows:

Steel Coupons: 1020 mild steel
Acid Solution: 7% HCl
Temperature: 77° C.
Testing Time: 4 hours
Iron as $Fe_3O_4$
Copper as CuO The test procedure was as follows:

Hydrochloric acid (900 ml of 7% aqueous solution) in a 1000 ml tall beaker is heated to 170° F. and the chemical to be tested is added at the appropriate concentration. Cleaned 1020 mild steel coupons ($\frac{7}{8}'' \times 3\frac{1}{4}'' \times 1/16''$) are weighed and then placed in acid by suspending on glass hooks for exactly four hours. The coupons are removed and washed with hot water, hot acetone, air dried and then reweighed. Protection is calculated in the usual manner from the weight loss of the blank ($W_1$) and weight loss ($W_2$) in the presence of inhibitor according to the formula:

$$\frac{W_1 - W_2}{W_1} \times 100 = \text{Percent Protection}$$

The plating-out of copper on the steel coupons is observed immediately after placing the coupons in the hot acid solution containing the added magnitite ($Fe_3O_6$) and copper oxide (CuO). At the end of the four hour test the coupons were copper coated and badly corroded in the case of the ineffective inhibitors.

The results of the test are set forth in Table 3 below.

TABLE 3

| INHIBITOR | CONC. ppm | % PROTECTION: No $Fe_3O_4$ No CuO | % PROTECTION: 17.5 g $Fe_3O_4$/liter 3.0 g CuO/liter | COMMENTS |
|---|---|---|---|---|
| Composition #1 (Ex. 40) | 1000 | 99 | 98 | Clean - No copper plated |
| Composition #2 (Ex. 41) | 1000 | 99 | 97 | Clean - No copper plated |
| Example 36 | 1000 | 90 | 45 | Copper plated-out |
| Example 37 | 1000 | 95 | 50 | Copper plated-out |
| Example 38 | 1000 | 35 | <10 | Copper plated-out |
| Example 39 | 1000 | 26 | <10 | Copper plated-out |
| "RODINE" 213* | 2000 | 99 | 55 | Copper plated-out |

*"RODINE" 213 is a commercial proprietary corrosion inhibitor of Alchem.

Example 40

Preparation of inhibitor composition No. 1

To a stirring vessel were added di(hydroxyethyl) aminomethyloctylsulfide (4 parts by weight), the surfactant of Example 38 (2 parts by weight), the surfactant of Example 39 (1 part by weight) and isopropanol (3 parts by weight). The components were stirred to afford a clear, homogeneous solution.

Example 41

Preparation of inhibitor composition No. 2

To a stirring vessel were added di(butyl) aminomethyl dodecylsulfide (7 parts/weight) and the surfactants of Examples 38 and 39 (2 parts/weight and 1 part/weight, respectively). The components were stirred at room temperature to afford a clear, homogeneous solution.

Example 42

This example illustrates the effectiveness of the inhibiting compositions of the present invention in the prevention of copper plate-out during the chemical cleaning of mild steel.

The data show that the inhibitor compositions of the invention prevent copper plating-out during chemical cleaning whereas the components of each composition alone, did not prevent copper plate-out.

The following examples illustrate the ability of the compositions of the invention to inhibit corrosion during chemical cleaning. In the examples, corrosion rates have been measured using a PAIR meter of the type described in U.S. Pat. No. 3,406,101 and by the weight loss method. In the case of PAIR meter testing, percent protection is calculated in the usual manner from corrosion rate ($R_1$) of the system without inhibitor and corrosion rate ($R_2$) in the presence of particular inhibitors according to the formula:

$$\frac{R_1 - R_2}{R_1} \times 100 = \text{Percent Protection}$$

In the weight loss method, corrosion protection is calculated in the usual manner from the weight loss of the blank. ($W_1$) and weight loss ($W_2$) in the presence of inhibitor according to the formula:

$$\frac{W_1 - W_2}{W_1} \times 100 = \text{Percent Protection}$$

The test conditions were as follows:

Steel Coupons: 1018 mild steel

Acid Solution: 10% HCl

Temperature: 77° C.

Testing Time: 4 Hours

The test procedure was the same as set forth in Example 42.

TABLE 4

Inhibition of Ferric Ion Corrosion

| EXAMPLE | INHIBITOR (1000 ppm) | SURFACTANT (1000 ppm) | PERCENT PROTECTION Without $Fe_3O_4$ | PERCENT PROTECTION 17.5 g $Fe_3O_4$ per liter |
|---|---|---|---|---|
| 43 | $C_8H_{17}SCH_2N(CH_2CH_2OH)_2$ | None | 90 | <50 |
| 44 | $C_8H_{17}SCH_2N(CH_2CH_2OH)_2$ | "ALFOL" 810 + 2.00 EtO | 98 | <50 |
| 45 | $C_8H_{17}SCH_2N(CH_2CH_2OH)_2$ | $C_8H_{17}SH$ + 1.00 EtO | 99 | 86 |
| 46 | $C_8H_{17}SCH_2N(CH_2CH_2OH)_2$ | "ARMEEN" T + 3.67 EtO | 95 | <50 |
| 47 | $C_8H_{17}SCH_2N(CH_2CH_2OH)_2$ | Nonylphenol + 1.00 EtO | 99 | 80 |
| 48 | $C_8H_{17}SCH_2N(CH_2CH_2OH)_2$ | di(Nonylphenol) + 1.37 EtO | 99 | 97 |
| 49 | $C_{12}H_{25}SCH_2N(C_4H_9)_2$ | None | 95 | <50 |
| 50 | $C_{12}H_{25}SCH_2N(C_4H_9)_2$ | "ARMEEN" T + 3.67 EtO | 96 | <50 |
| 51 | $C_{12}H_{25}SCH_2N(C_4H_9)_2$ | "ALFOL" 810 + 2.00 EtO | 99 | <50 |
| 52 | $C_{12}H_{25}SCH_2N(C_4H_9)_2$ | Dinonylphenol + 1.37 EtO | 99 | 98 |
| 53 | None | "ALFOL" 810 + 2.00 EtO | 25 | <10 |
| 54 | None | $C_8H_{17}SH$ + 1.00 EtO | 50 | <10 |
| 55 | None | "ARMEEN" T + 3.67 EtO | 32 | <10 |
| 56 | None | Nonylphenol + 1.00 EtO | 30 | <10 |
| 57 | None | Dinonylphenol + 1.37 EtO | 42 | <10 |
| 58 | "RODINE" 213 | None | 99 | 65 |

The results of Table 4 clearly demonstrate the effectiveness of the inhibitors of the present invention in inhibiting hydrogen evolution corrosion and ferric ion corrosion. The two commercial inhibitors are very effective in the absence of ferric ions but provide much lower protection in the presence of ferric ions.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

I claim:

1. Composition comprising a blend of at least one α-aminoalkylsulfide and at least one surface active agent.

2. Composition of claim 1 wherein said α-aminoalkylsulfide is represented by the formula

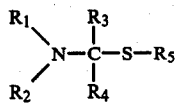

wherein $R_1$, $R_2$, $R_3$, $R_4$ $R_5$ are the same or different and independently represent hydrogen, a hydrocarbon group or a substituted hydrocarbon group and wherein at least two of $R_1$, $R_2$, $R_3$, $R_4$, $R_5$ may be joined to form a heterocyclic ring.

3. Composition of claim 2 wherein said α-aminoalkylsulfide is di(hydroxyethyl) aminomethyl octylsulfide.

4. Composition of claim 2 wherein said α-aminoalkylsulfide is di(butyl) aminomethyl dodecylsulfide.

5. Composition of claim 2 wherein said α-aminoalkylsulfide is diallylaminomethyl octylsulfide.

6. Composition of claim 1 wherein said surface active agent is anionic.

7. Composition of claim 1 wherein said surface active agent is cationic.

8. Composition of claim 1 wherein said surface active agent is nonionic.

9. Composition of claim 8 wherein said nonionic surface active agent is represented by the formula

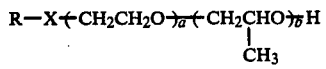

wherein R is a hydrocarbon group; X is sulfur, oxygen or nitrogen; and a and b independently represent a number of from 0 to about 30.

10. Composition of claim 9 wherein said surface active agent is a mixture of ethoxylated, propoxylated linear $C_8$–$C_{10}$ alcohols.

11. Composition of claim 9 which is represented by the formula

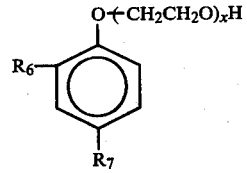

wherein $R_6$ and $R_7$ independently represent 4–10 carbon atom linear or branched-chain carbon radicals; and x represents a number of from 2 to about 10.

12. Composition of claim 11 wherein $R_6$ and $R_7$ each represent a nonyl radical.

13. Composition of claim 1 wherein said blend comprises di(hydroxyethyl) aminomethyl octyl sulfide, a mixture of ethoxylated, propoxylated linear $C_8$–$C_{10}$ alcohols and an ethoxylated dinonyl phenol.

14. Composition of claim 1 wherein said blend comprises di(butyl) aminomethyl dodecylsulfide, a mixture of ethoxylated, propoxylated linear $C_8$–$C_{10}$ alcohols and an ethoxylated dinonyl phenol.

15. Composition of claim 1 wherein said blend comprises diallylaminomethyl octyl sulfide, a mixture of ethoxylated, propoxylated linear $C_8$–$C_{10}$ alcohols and an ethoxylated dinonyl phenol.

16. Method of inhibiting corrosion and copper plate-out during chemical cleaning of a system in contact with steam and/or condensate comprising adding to said system an effective inhibiting amount of a composition of claim 1.

17. Method of claim 16 wherein said system is a steam generation plant.

18. Method of claim 16 wherein said system is a condenser.

19. Method of claim 16 wherein said system is a heat exchanger.

20. Method of claim 16 wherein said system is a boiler.

21. Single fill acid cleaning process for cleaning a system in contact with steam and/or condensate comprising adding to said system an acid and an effective inhibiting amount of a composition of claim 1.

22. Composition comprising aqueous hydrochloric acid and a blend of at least one α-aminoalkylsulfide and at least one surface active agent.

* * * * *